US007628134B2

(12) United States Patent
Scharp

(10) Patent No.: US 7,628,134 B2
(45) Date of Patent: Dec. 8, 2009

(54) PISTON FOR AN INTERNAL COMBUSTION ENGINE

(75) Inventor: Rainer Scharp, Vaihingen (DE)

(73) Assignee: Mahle GmbH, Stuttgart (DE)

( * ) Notice: Subject to any disclaimer, the term of this patent is extended or adjusted under 35 U.S.C. 154(b) by 795 days.

(21) Appl. No.: 10/574,750

(22) PCT Filed: Oct. 4, 2004

(86) PCT No.: PCT/DE2004/002209

§ 371 (c)(1),
(2), (4) Date: May 16, 2006

(87) PCT Pub. No.: WO2005/035960

PCT Pub. Date: Apr. 21, 2005

(65) Prior Publication Data

US 2009/0250033 A1 Oct. 8, 2009

(30) Foreign Application Priority Data

Oct. 6, 2003 (DE) ..... 103 46 822

(51) Int. Cl.
*F02F 3/22* (2006.01)

(52) U.S. Cl. ..... 123/193.6

(58) Field of Classification Search ..... 123/193, 123/6, 41.35; 92/186; 29/888.04, 888.045
See application file for complete search history.

(56) References Cited

U.S. PATENT DOCUMENTS

| | | | | |
|---|---|---|---|---|
| 2,017,662 | A | 10/1935 | Johnson | |
| 2,080,705 | A | 5/1937 | Freer | |
| 4,377,967 | A | 3/1983 | Pelizzoni | |
| 5,357,920 | A | 10/1994 | Kemnitz et al. | |
| 6,487,773 | B1 * | 12/2002 | Scharp et al. | 29/888.04 |
| 6,659,062 | B1 * | 12/2003 | Issler | 123/193.6 |
| 6,772,846 | B1 * | 8/2004 | Scharp | 173/1 |
| 2005/0072394 | A1 * | 4/2005 | Gabriel et al. | 123/193.6 |

FOREIGN PATENT DOCUMENTS

| | | | |
|---|---|---|---|
| CH | 662 863 | A5 | 10/1987 |
| DE | 38 30 033 | A1 | 6/1989 |
| DE | 197 20 958 | A1 | 11/1998 |
| DE | 102 47 218 | A1 | 7/2003 |
| DE | 102 09 168 | A | 9/2003 |
| EP | 0 799 373 | B | 1/1999 |
| WO | WO 03/085251 | A1 | 10/2003 |

OTHER PUBLICATIONS

International Search Report.

* cited by examiner

*Primary Examiner*—M. McMahon
(74) *Attorney, Agent, or Firm*—Collard & Roe, P.C.

(57) ABSTRACT

The invention relates to a piston for an internal combustion engine comprising an annular cooling channel embodied in the edge area of the piston head and closed on a rod side with a cover consisting of two semicircular half-shells which are oriented with the internal sides thereof towards the piston and provided with a circular groove for arranging the half-shells on a projection embodied on the external side of the piston. The half-shells are provided on the abutting surfaces thereof with rest connections for easily connecting the half-shells to each other.

8 Claims, 4 Drawing Sheets

PISTON FOR AN INTERNAL COMBUSTION ENGINE

CROSS REFERENCE TO RELATED APPLICATIONS

Applicant claims priority under 35 U.S.C. §119 of German Application No. 103 46 822.6 filed Oct. 6, 2003. Applicant also claims priority under 35 U.S.C. §365 of PCT/DE2004/002209 filed Oct. 4, 2004. The international application under PCT article 21(2) was not published in English.

The invention relates to a piston for an internal combustion engine, in accordance with the preamble of claim 1.

A piston having a cooling channel disposed in the edge region of the piston crown is known from the European Patent EP 0 799 373 B1, which is covered on the skirt side by a two-part cover ring that stands under mechanical stress. The very complicated assembly of the cover ring, in particular, is disadvantageous in this connection. For assembly, the two elements of the cover ring, shaped as semi-circles, must first be biased using a relatively complicated special tool, so that they can be introduced into supports on the piston head, intended for this purpose, in the biased state.

It is the task of the present invention to avoid this disadvantage of the state of the art.

The problem is solved with the characteristics contained in the characterizing part of the main claim. Practical embodiments of the invention are the object of the dependent claims.

It is advantageous, for one thing, that the cover of the cooling channel, consisting of two half-shells, according to the invention, has a groove that is directed inward, by way of which the half-shells can be quickly and easily pushed onto a projection on the outside of the piston, which is shaped complementary to the groove shape. For another thing, the half-shells have snap-in connections in the region of the contact surfaces, by means of which the half-shells can be quickly connected with one another.

Figure 1:
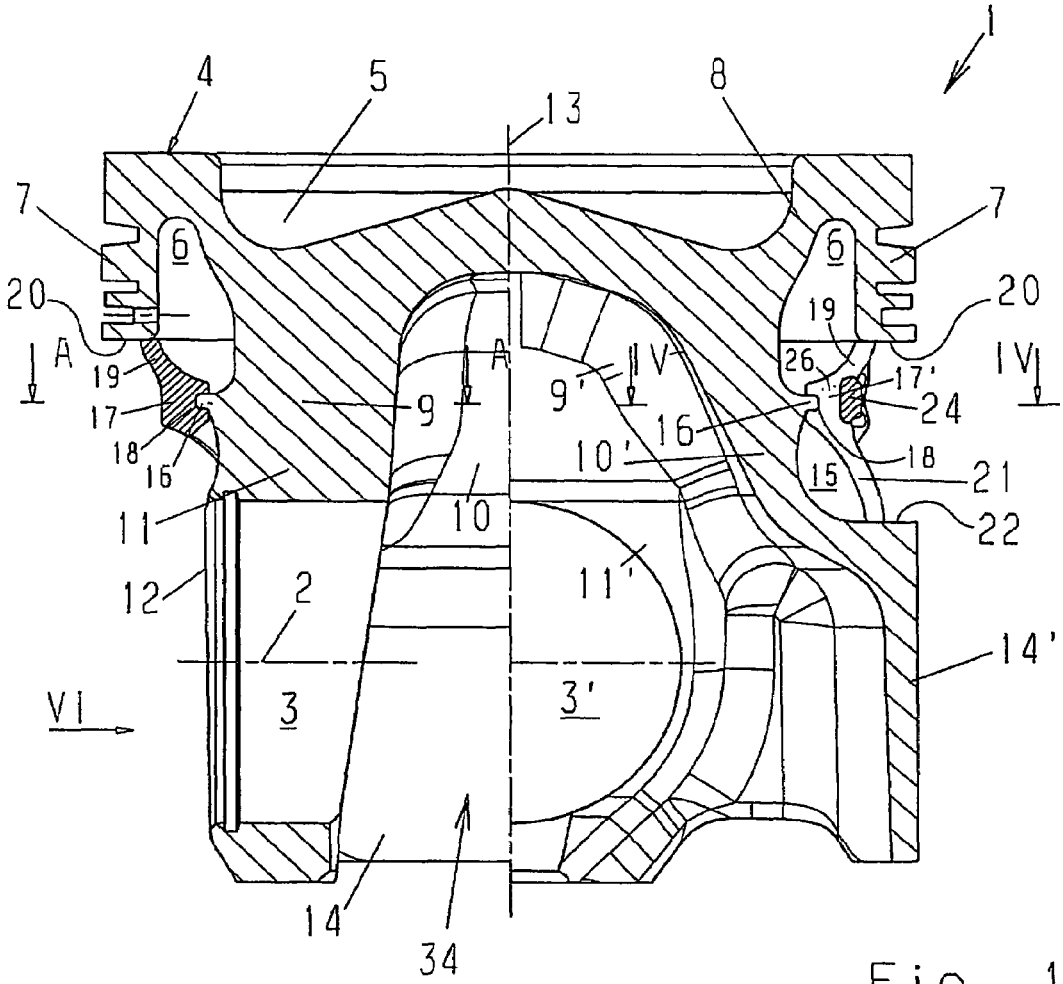
Figure 2:
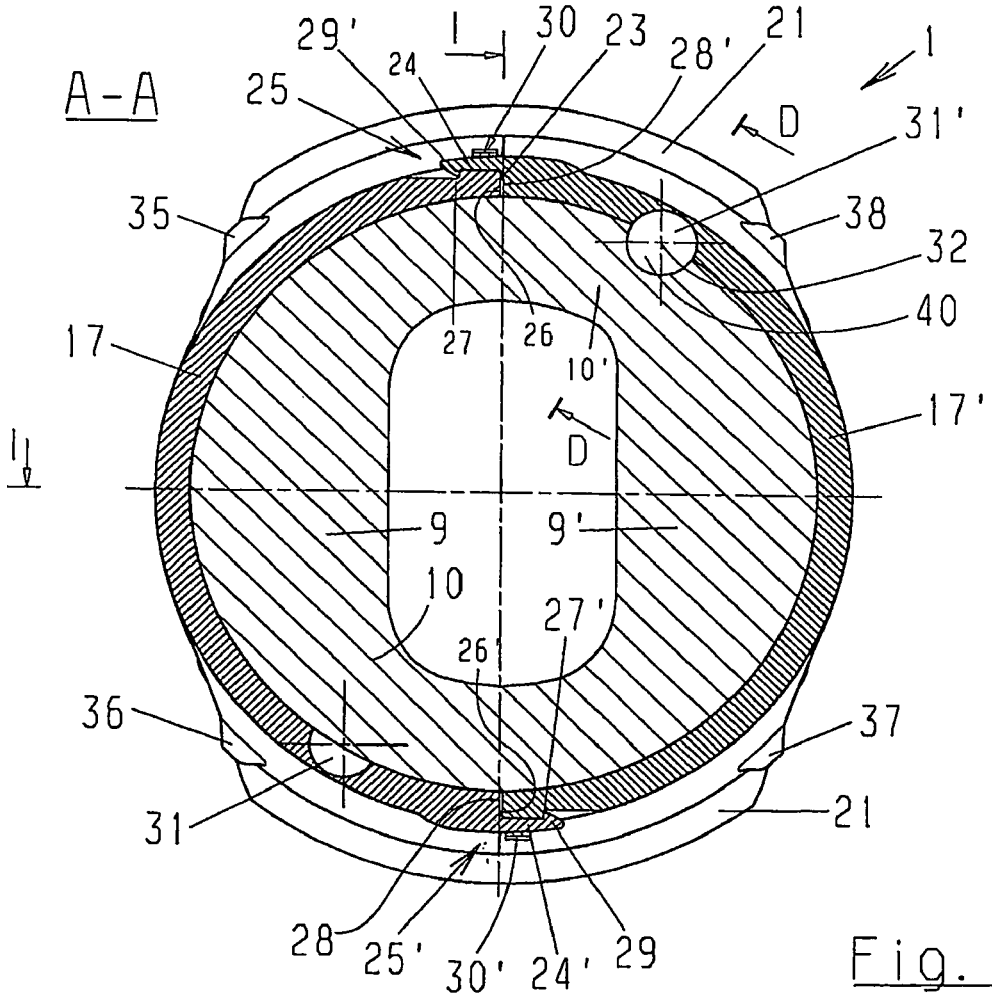
Figure 3:
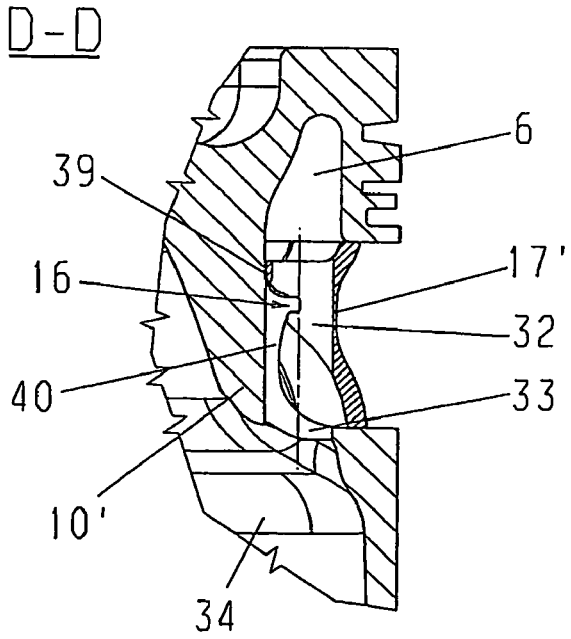
Figure 4:
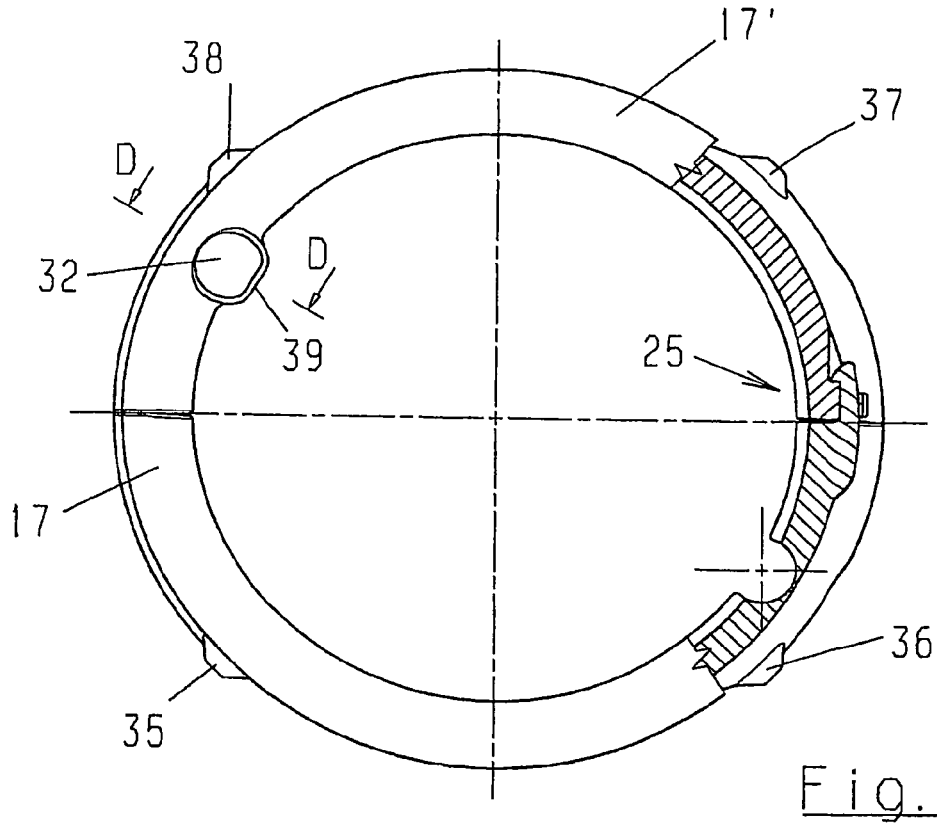
Figure 5:
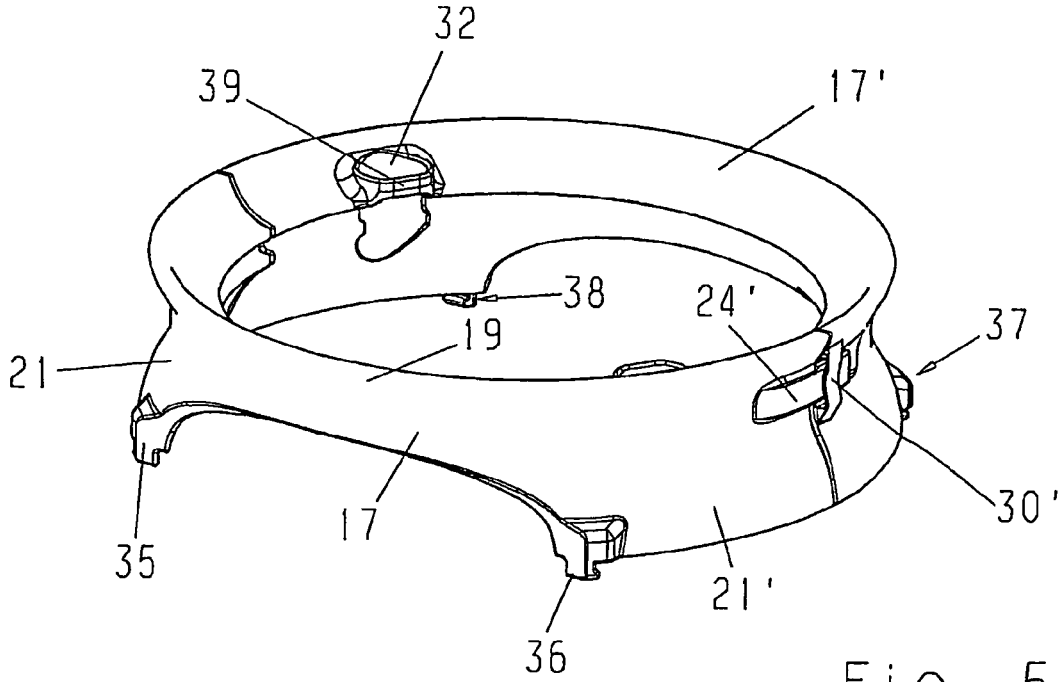
Figure 6:
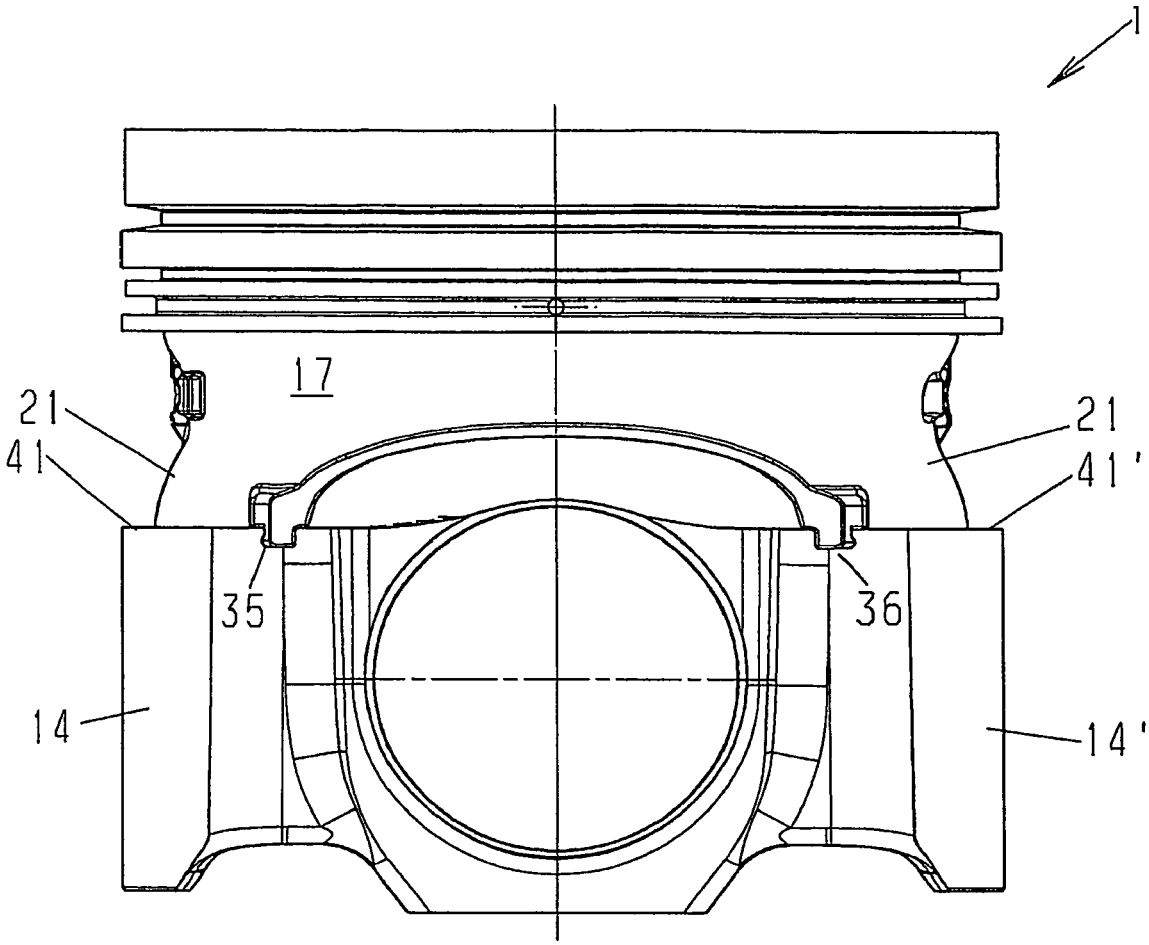

An exemplary embodiment of the invention will be described in the following, using the drawings. These show:

FIG. 1 a piston for an internal combustion engine, having a cooling channel that is closed off by half-shells, represented in a sectional diagram that consists of two halves, along the angled line I-I in FIG. 2, FIG. 2 a section through the entire piston along the line A-A in FIG. 1, FIG. 3 a section along the line D-D in FIG. 2 and FIG. 4, respectively, FIG. 4 a top view of the two engaged half-shells with a partial section in the region of the snap-in connection, along the line IV-IV in FIG. 1, FIG. 5 a perspective view of the two engaged half-shells, and FIG. 6 a side view of the piston in the direction of the arrow VI in FIG. 1, with a cooling channel closed off by the half-shells, according to the invention.

FIG. 1 shows a piston 1 for an internal combustion engine, configured in one piece, in a sectional diagram along the line I-I in FIG. 2, that consists of two halves, of which the left half shows a section of the piston 1 along a longitudinal axis 2 of a pin bore 3, and the right half shows a longitudinal section of the piston 1 offset by 90° relative to the former. The piston 1 is made of steel and has a combustion chamber bowl 5 in the region of the piston crown 4. In the radially outer region of the piston crown 4, a ring-shaped cooling channel 6 that runs around the circumference is disposed, the radially outer delimitation of which is formed by a ring wall 7 that is molded onto the piston crown 4, and the radially inner delimitation of which is formed partly by a ring rib 8, partly by a pin boss support 9, 9', and partly by a skirt connection 10, 10'. The ring wall 7 serves as a piston ring carrier in this connection.

Above the pin boss supports 9, 9', one pin boss 11, 11' with a pin bore 3, 3', in each instance, are each molded onto the piston crown 4. The faces 12 of the pin bosses 11, 11' are disposed set back relative to the ring wall 7, in the direction of the piston longitudinal axis 13. The pin bosses 11, 11' are connected with one another by way of skirt elements 14, 14', which are each molded onto the piston crown 4 by way of a shaft connection 10, 10'. Between the skirt elements 14, 14' and the ring wall 7, the piston 1 has recesses 15

On the radially outer side of the pin bosses 11 and 11', and on the shaft connection 10, 10', a circumferential, projection 16 is molded on, which has a cross-sectional shape formed in essentially rectangular manner, and the function of which consists in serving as a holding rail for two half-shells 17 and 17', by which the cooling channel 6 is closed off, and by which the recesses 15 are furthermore covered in the region of the skirt elements 14 and 14'. For this purpose, the half-shells 17, 17' each have a circumferential groove 18 on their insides, the inside surface of which groove is configured complementary to the outside surface of the projection 16, to such an extent that the half-shells 17, 17' can be pushed onto the projection 16 by way of their grooves 18. In the present exemplary embodiment, the half-shells 17, 17' consist of a heat-resistant plastic and are produced using the injection-molding method. It lies within the scope of the invention that the half-shells 17, 17' can also consist of a different material, such as steel or aluminum, for example, whereby the half-shells can be cast or forged.

As will be explained below, the cross-sectional shape of the half-shells 17, 17' varies as a function of whether they cover the cooling channel 6 in the region of the faces 12 of the pin bosses 11, 11', as shown in the left half of FIG. 1, or cover the cooling channel 6 in the region of the shaft elements 14, 14', as shown in the right half of the sectional diagram according to FIG. 1. In the region of the faces 12 of the pin bosses 11, 11', the half-shells have aprons 19 directed only upward in the direction of the piston crown 4, which aprons rest against the skirt-side face 20 of the ring wall 7, whereas they do not form themselves against anything in the direction of the faces 12, due to a lack of contact possibilities. In contrast, as shown in the right half of the sectional diagram according to FIG. 1, the half-shells 17, 17' have skirt-side aprons 21 in the region of the skirt elements 14, 14', in addition to the aprons 19 on the piston crown side (see also FIG. 5), which come into contact on steps 22 of the skirt elements 14, 14' on the piston crown side.

The function of the two aprons 19 and 21, 21' consists in supporting the half-shells 17, 17' partly relative to the skirt-side face 20 of the ring wall 7, and partly relative to the steps 22 of the skirt elements 14, 14' on the piston crown side, particularly during faster back and forth movements of the piston, and thereby reliably fixing them in place in the axial direction. Furthermore, the half-shells 17, 17', if they consist of steel, form a support for the ring wall 7 and therefore for the edge of the piston crown 4, making it possible to prevent bending of the piston crown edge in the direction of the pin bosses 11, 11' in the case of greater stresses on the piston 1.

The section through the piston 1 and through the two half-shells 17 and 17' along the line A-A or IV-IV, respectively, in FIG. 1, as shown in FIG. 2, first of all shows that the section of the half-shells 17, 17' shown in the right half of FIG. 1 goes through the gap 23 between the contact surfaces {26, 28'} and {26', 28} of the half-shells 17 and 17', so that in the right sectional diagram of FIG. 1, the contact surface 26 of the half-shell 17' is shown in a top view, and its snap-in arm 24 is shown in cross-section.

In FIG. 2, sections of the piston 1 through the pin boss supports 9, 9' and through the skirt connections 10, 10' can be seen. Furthermore, the spatial distribution of the pin-boss-side aprons 21 and 21' of the half-shells 17, 17' are shown, which reach over a fourth of the circle formed by the half-shells 17, 17', on opposite sides, in each instance and, according to FIG. 1, are disposed exclusively in the region of the skirt elements 14, 14'. In particular, FIG. 2 shows the snap-in connections 25 and 25', by means of which the two half-shells 17, 17' are held together and therefore are also attached to the piston 1. In this connection, the circumferential projection 16 molded onto the piston body, onto which the half-shells 17, 17' are pushed by way of their circumferential grooves 18, serves to fix the half-shells 17, 17' in place in the axial direction, and the snap-in connections 25, 25' serve to fix them in place in the radial direction.

The snap-in connections 25, 25' each consist of undercuts 27, 27' made in the region of the one contact surfaces 28, 28' of the half-shell 17, 17', on its outside, and of snap-in arms 24, 24' having snap-in hooks 29, 29', directed inward and molded on in the region of the other contact surfaces 26, 26' of the half-shells 17, 17', in each instance, which snap into the undercuts 27, 27' of the other half-shell 17', 17, in each instance, when the two half-shells 17, 17' are joined together. In the region of the contact surfaces 28, 28', holder brackets 30, 30' (see also FIG. 5 in this regard) are affixed, in such a manner that when the half-shells 17, 17' are joined together, their snap-in arms 24, 24' can be introduced into the loops formed by the holder brackets 30, 30'. The holder brackets 30, 30' simplify assembly of the half-shells 17, 17', since they form a guide for the snap-in arms 14, 14' in this connection. For another thing, they offer a certain security against unintentional release of the snap-in connections 25, 25' under extreme stress on the piston 1.

Furthermore, the half-shells 17, 17' have semi-circular recesses 31, 31' in cross-section, whereby one of the recesses 31' corresponds to a recess 40 that is also semi-circular in cross-section and affixed in the region of the projections 16 on the piston outside, and thereby forms a circular opening 32 in cross-section. Furthermore, little feet 35 to 38 molded onto the half-shells shells 17, 17' are shown in FIG. 2, the shape and function of which will be explained further below.

Using FIG. 3, a cross-section along the line D-D according to FIG. 2 and FIG. 4, respectively, the function of the opening 32 worked partly into the projection 16 and partly into the half-shell 17' will be explained; it is directed axially and is extended all the way into the piston interior 34, by way of an opening 33 that is made in the skirt connection 10'. The function of the channel formed by the openings 32 and 33 is to guide cooling oil that has been injected into the piston interior 34, particularly in the direction of the opening 33, into the cooling channel 6. Furthermore, FIG. 3 also shows the collar 39 that delimits the opening 32 on the piston crown side, which is also shown in FIGS. 4 and 5.

FIG. 4 shows the half-shells 17 and 17' in a top view, whereby the region around the snap-in connections 25 is shown in partial cross-section along the line IV-IV in FIG. 1.

The perspective representation of the joined half-shells 17 and 17' according to FIG. 5 shows, for one thing, the arrangement of both the apron 19 on the piston crown side and of the aprons 21 and 21' on the skirt side. For another thing, it can be seen that the little feet 35 to 38 are affixed on the edges of the skirt-side aprons 21 and 21', specifically in such a manner that they project beyond the sides of the skirt elements 14, 14', as particularly shown in the side view of the piston 1 (in the direction of the arrow VI in FIG. 1) that is shown in FIG. 6, and that the skirt-side aprons 21, 21' of the half-shells 17, 17' rest on the faces 41, 41' of the skirt elements 14, 14' on the piston crown side. In this way, the position of the half-shells 17, 17' relative to the piston 1 can be clearly fixed in place.

REFERENCE SYMBOL LIST

1 piston
2 longitudinal axis
3, 3' pin bore
4 piston crown
5 combustion chamber bowl
6 cooling channel
7 ring wall
8 ring rib
9, 9' pin boss support
10, 10' skirt connection
11, 11' pin boss
12 face of the pin boss 11, 11'
13 piston longitudinal axis
14, 14' skirt element
15 recess
16 projection
17, 17' half-shell, cover
18 groove in the half-shells 17, 17'
19 aprons of the half-shells 17, 17' on the piston crown side
20 skirt-side face of the ring wall 7
21, 21' aprons of the half-shells 17, 17' on the skirt side
22 step of the skirt elements 14, 14'
23 gap
24, 24' snap-in arm
25, 25' snap-in connection
26, 26' contact surface
27, 27' undercut
28, 28' contact surface
29, 29' snap-in hook
30, 30' holder bracket
31, 31' recess
32 opening
33 opening
34 piston interior
35 to 38 little feet
39 collar
40 recess in the projection 16
41, 41' faces of the skirt elements 14, 14'

The invention claimed is:

1. Piston (1) for an internal combustion engine, having a piston crown (4), having two pin boss supports (9, 9') molded onto the piston crown (4) for two pin bosses (11, 11'), whereby the pin boss supports (9, 9') are disposed set back relative to the radially outer edge of the piston crown (4), in the direction of the piston longitudinal axis (13), having two skirt elements (14, 14') that connect the pin bosses (11, 11'), and having a ring-shaped cooling channel (6) disposed in the edge region of the piston crown (4), the radially outer delimitation of which is formed by a ring wall (7) molded onto the piston crown (4), the radially inner delimitation of which is formed partly by the pin boss supports (9, 9') and partly by a ring rib (8) molded onto the piston crown (4), and whose skirt-side delimitation is formed by a two-part cover (17, 17'), wherein a circumferential projection (16) is formed close to the cooling channel (6), on the piston outside, that the cover consists of two semi-circular half-shells (17, 17'), which each have a circumferential groove (18) on the inside facing the piston, having a groove shape that is complementary to the shape of the projection (16), to such an extent that the half-shells (17, 17') can be pushed onto the projection (16) by way of the groove (18), in each instance, that the half-shells (17, 17') each have an apron (19) on the piston crown side, by way of which the half-shells (17, 17') rest against the skirt-side face (20) of the ring wall (7), and that the half-shells (17, 17') have snap-in connections (25, 25') in the region of their contact surfaces (26, 26', 28, 28'), by means of which the half-shells (17, 17') that have been pushed onto the projection (16) can be connected with one another.

2. Piston (1) for an internal combustion engine, according to claim 1, wherein the half-shells (17, 17') consist of a heat-resistant plastic.

3. Piston (1) for an internal combustion engine, according to claim 1, wherein the half-shells (17, 17') consist of steel.

4. Piston (1) for an internal combustion engine, according to claim 1, wherein the half-shells (17, 17') consist of aluminum.

5. Piston (1) for an internal combustion engine, according to claim 1, wherein the half-shells (17, 17') have skirt-side aprons (21, 21') in the region of the skirt elements (14, 14'), which aprons rest on piston-crown-side steps (22) of the skirt elements (14, 14').

6. Piston (1) for an internal combustion engine, according to claim 1, wherein the snap-in connections (25, 25') consist of undercuts (27, 27') made in the region of the one contact surfaces (28, 28') of the half-shells (17, 17'), on their outsides, directed inward, and of snap-in arms (24, 24') having snap-in hooks (29, 29'), directed inward and molded on in the region of the other contact surfaces (26, 26') of the half-shells (17, 17'), in each instance, which can snap into the undercuts (27, 27').

7. Piston (1) for an internal combustion engine, according to claim 1, wherein the half-shells (17, 17') have semi-circular recesses (31, 31') on their insides, in cross-section, which correspond to recesses (40) that are also semi-circular in cross-section, at least in part, and are molded into the outside of the projection (16), and thereby form openings (32) that are circular in cross-section and oriented axially, which open into the cooling channel (6), on the one hand, and into the piston interior (34), by way of openings (33) made in the skirt connection, on the other hand.

8. Piston (1) for an internal combustion engine, according to claim 6, wherein the half-shells (17, 17') have holder brackets (30, 30') oriented in the direction of the piston longitudinal axis (13), between the undercuts (27, 27') and the one contact surfaces (28, 28'), on their outsides, by means of which brackets loops are formed, into which the snap-in arms (24, 24') can be guided during assembly of the half-shells (17, 17').

* * * * *

UNITED STATES PATENT AND TRADEMARK OFFICE

CERTIFICATE OF CORRECTION

PATENT NO. : 7,628,134 B2
APPLICATION NO. : 10/574750
DATED : December 8, 2009
INVENTOR(S) : Rainer Scharp It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 876 days.

Signed and Sealed this

Second Day of November, 2010

David J. Kappos

David J. Kappos
*Director of the United States Patent and Trademark Office*